US005526800A

United States Patent [19]

Christian

[11] Patent Number: 5,526,800

[45] Date of Patent: Jun. 18, 1996

[54] ADJUSTABLE ARCHERY ARROW SUPPORT ASSEMBLY

[76] Inventor: Sherrell G. Christian, 30659 Symphony La., Albany, La. 70711

[21] Appl. No.: 290,695

[22] Filed: Aug. 15, 1994

[51] Int. Cl.[6] ..... F41B 5/22

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 1,847,593 | 3/1932 | Cameron . | |
| 2,665,679 | 1/1954 | Gaskell . | |
| 2,743,716 | 5/1956 | Wendt | 124/44.5 |
| 3,059,631 | 10/1962 | Yasho . | |
| 3,108,584 | 10/1963 | Coe | 124/24.1 |
| 3,285,237 | 11/1966 | Wolfe . | |
| 3,292,607 | 12/1966 | Hoyt . | |
| 3,372,686 | 3/1968 | Losh . | |
| 3,482,563 | 12/1969 | Pint . | |
| 3,494,347 | 2/1970 | Saunders . | |
| 3,698,375 | 10/1972 | Brougham | 124/24.1 |
| 3,757,764 | 9/1973 | Ikeya | 124/44.5 |
| 3,828,757 | 8/1974 | Finlay | 124/44.5 |
| 3,871,352 | 3/1975 | Stanislawski et al. | 124/44.5 |
| 3,890,951 | 6/1975 | Jennings et al. | 124/44.5 |
| 3,918,428 | 11/1975 | Wilson et al. | 124/44.5 |
| 4,119,078 | 10/1978 | Wilson et al. | 124/44.5 |
| 4,324,221 | 4/1982 | Peck | 124/24.1 |
| 4,421,092 | 12/1983 | Christian | 124/44.5 |
| 4,569,325 | 2/1986 | Christian | 124/44.5 |
| 4,899,716 | 2/1990 | Martin et al. | 124/44.5 |
| 4,917,072 | 4/1990 | Chang | 124/44.5 |
| 5,085,201 | 2/1992 | Tepper et al. | 124/44.5 |
| 5,095,884 | 3/1992 | Mertens | 124/44.5 |
| 5,103,797 | 4/1992 | Newbold | 124/44.5 |
| 5,117,803 | 6/1992 | Johnson | 124/44.5 |
| 5,285,764 | 2/1994 | Mertens | 124/44.5 |

*Primary Examiner*—Eric K. Nicholson
*Assistant Examiner*—John A. Ricci
*Attorney, Agent, or Firm*—David L. Ray

[57] ABSTRACT

An adjustable archery arrow support assembly which permits an archery bow to be "tuned" to an individual archer's arrow releasing characteristics. The archery arrow support device of the invention is adjusted by rotating the archery arrow support device about a horizontal axis perpendicular to the vertical axis of the archery bow to which the adjustable archery arrow support device of the invention is attached.

23 Claims, 3 Drawing Sheets

ADJUSTABLE ARCHERY ARROW SUPPORT ASSEMBLY

BACKGROUND OF THE INVENTION

1. Field of the Invention

The present invention generally involves those devices used in archery to support the arrow on the side of the bow during target shooting and hunting conditions. More specifically, the invention relates to an archery arrow support device using a rigidly-constructed, spring-loaded yoke assembly as the supporting member.

2. Description of the Related Art

As stated in my U.S. Pat. Nos. 4,421,092 and 4,569,325, prior art has recognized the problems inherent in the drawing and releasing of a bowstring without causing inconsistent vertical and lateral displacement forces to be imposed on the arrow which influence it to assume inconsistent bending patterns on impact of release and during acceleration out of the bow. Vertical displacement force is intentionally achieved by nocking the arrow somewhat above the horizontal center line of force, influencing the arrow to assume a downward bend at the impact of release. Unintentional vertical displacement forces are present due to inconsistent release problems, variations in pressure in the archer's bow arm and hand, and unavoidable imbalances in the bow limbs, all of which are transferred to the bowstring and to the arrow nocked thereon. Lateral displacement force is generated by lateral displacement of the bowstring at the instant of release, the finger style of shooting causing the greatest degree of displacement, and modern mechanical release devices causing little or no lateral displacement.

Lateral displacement of the bowstring is also caused by any lateral movement of the archer's bow hand, wrist, arm, or body or by torque built into the bow during manufacture due to inconsistency in alignment and limb balance. Lateral displacement of the accelerating arrow shaft can be caused by interaction of vertical and lateral arrow-supporting members of the arrow support system. Prior art recognizes that any lateral displacement is undesirable using cushioning devices to compensate for it.

Arrow support devices which minimize these problems are disclosed in my U.S. Pat. Nos. 4,421,092 and 4,569,325. The present invention is directed towards improving the devices disclosed in U.S. Pat. Nos. 4,421,092 and 4,569,325.

Other devices are used to compensate for variations in vertical displacement, assuming that lateral displacement is not present when using mechanical release devices. Exemplary of additional archery arrow support devices of the prior art are U.S. Pat. Nos. 1,847,593; 2,665,679; 2,743,716; 3,059,631; 3,108,584; 3,285,327; 3,292,607; 3,372,686; 3,482,563; 3,494,347; 3,698,375; 3,757,764; 3,828,757; 3,871,352; 3,890,951; 3,918,428; 4,119,078; 4,324,221; 4,917,072; and 5,103,797.

In my U.S. Pat. Nos. 4,421,092 and 4,569,325, it was stated that both vertical and lateral displacement forces may be present during release and acceleration of the shot, and that it is apparent that if two displacement forces-one in the vertical direction and one in the lateral direction-act in combination on the arrow during release and acceleration, a net force is imparted to the arrow which will influence the arrow to bend along a theoretical net line of force. It is also apparent that if the vertical and lateral displacement forces are of inconsistent amplitude, the degree of difference between the values of the two forces will produce radial inconsistency of the theoretical net line of force, causing the arrow to bend and fly accordingly.

As known in the art, some archers use their fingers to grip the bowstring while drawing the bowstring backward to bend the bow, and to release the bowstring. Other archers use a release aid which prevents their fingers from touching the bowstring. It has been found that when using a properly tuned bow, finger shooters cause the first bend of the arrow to be generally toward 4:00 o'clock and release aid shooters will cause the first bend of the arrow to be toward 6:00 o'clock.

An arrow support device which could be adjusted to accommodate both finger shooters and release shooters, and the individual characteristics of both shooters, would thus enable a bow to be further tuned to the individual archer.

SUMMARY OF THE INVENTION

In accordance with the present invention there is provided an adjustable archery arrow support assembly which permits an archery bow to be "tuned" to an individual archer's arrow releasing characteristics. The archery arrow support device of the invention is adjusted by rotating the archery arrow support device about a horizontal axis perpendicular to the vertical axis of the archery bow to which the adjustable archery arrow support device of the invention is attached.

The present invention has the advantage of permitting the skilled archer to rapidly and precisely tune his archery bow to compensate for the vertical and lateral forces imposed on the arrow which cause bending of the arrow during acceleration and release of the arrow from the bow.

DESCRIPTION OF THE PREFERRED EMBODIMENTS

The present invention is an improvement of my U.S. Pat. Nos. 4,421,092 and 4,569,325, which are hereby incorporated by reference.

Figure 1:
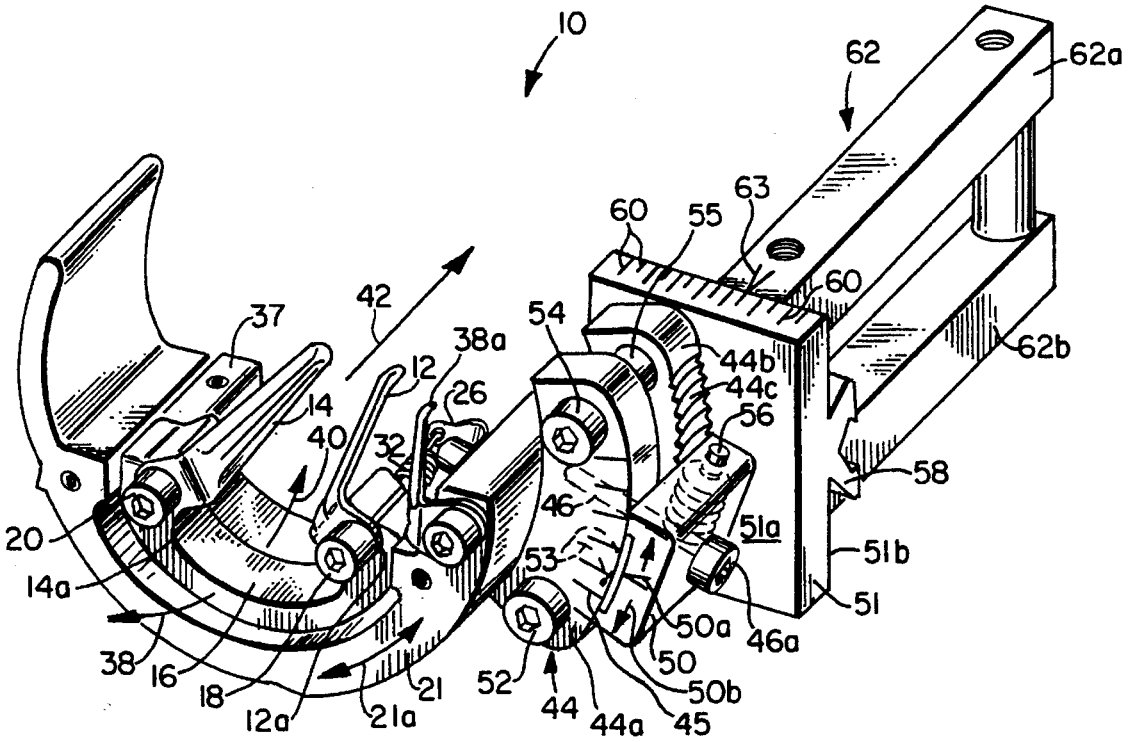
FIG. 1 is a perspective view of the invention.
Figure 2:
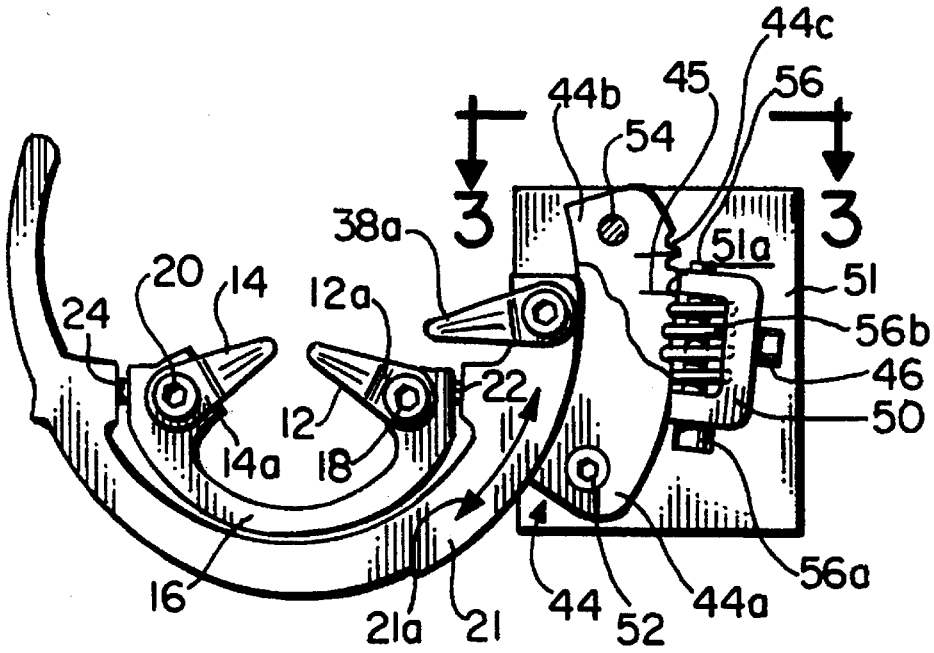
FIG. 2 is a partly cut-away, partly sectional, front elevational view of the invention.
Figure 4:
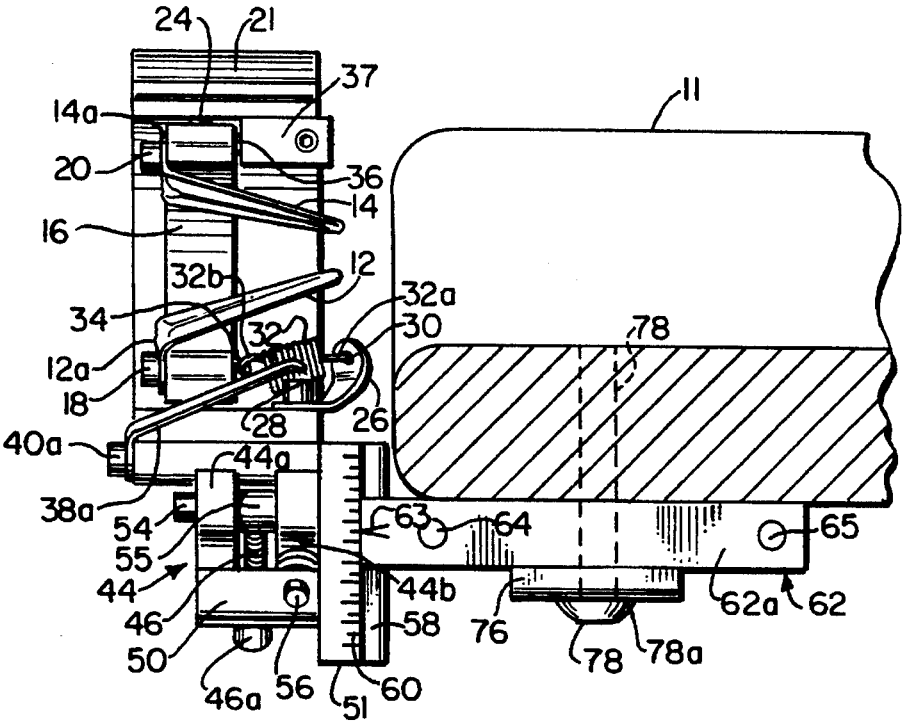
FIG. 4 is a top view of the invention shown connected to an archery bow, the archery bow being shown in a fragmentary, partly sectional view.
Figure 5:
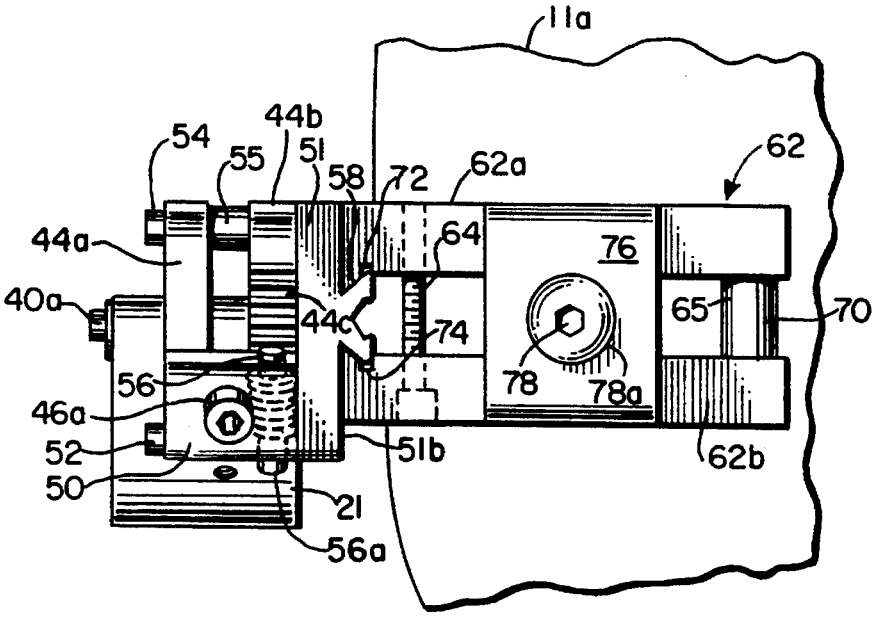
FIG. 5 is an elevational side view of the invention shown connected to an archery bow, the archery bow being shown in a fragmentary view.

Referring now to the drawings, in FIG. 1 is shown the adjustable archery arrow support assembly of the invention generally indicated by the numeral 10. In FIGS. 4 and 5 the adjustable archery arrow support assembly 10 is shown attached to the handle section 11*a* of an archery bow 11. The adjustable archery arrow support assembly 10 includes a pair of elongated, generally non-resilient arrow support members 12 and 14, adapted with mounting flanges 12*a* and 14*a*, mounted to yoke 16 by suitable means such as screws 18 and 20 as shown in FIGS. 1, 2, and 4. Arrow support members 12 and 14 and yoke 16 are intended to be as non-yielding as materials, space limitations, and weight considerations will allow, providing in combination an arrow support-yoke assembly, which moves as a unit as indicated in my U.S. Pat. Nos. 4,421,092 and 4,569,325. The outer tips of arrow support members 12 and 14 can be provided with a cushion material to minimize noise for hunting purposes.

Yoke 16, with arrow support members 12 and 14 attached thereto, is secured in pivot frame 21 by pivot pins 22 and 24. Spring holder arm 26 is connected to pivot frame 21 by screw 28. Spring holder arm 26 has an eye or hole 30 for receipt of one end 32*a* of coil spring 32. The opposite end 32*b* of coil spring 32 is connected to yoke 16 by ring 34. Ring 34 is rigidly attached to yoke 16. A stop 36 is rigidly connected to stop holder 37 to limit the rotation of yoke 16, and stop holder 37 is rigidly connected to pivot frame 21. Thus yoke 16 rotates or pivots about pivot pins 22 and 24 in the directions indicated by arrows 38 and 40 shown in FIG. 1 when an arrow is released therefrom. Coil spring 32 biases yoke 16 toward stop 36 during rotation or pivoting of yoke 16.

An arrow guide member 38*a* is preferably connected to pivot frame 21 by screw 40*a*, although if desired, arrow guide member 38 could be deleted. Arrow guide member 38*a* guides the point of the arrow toward arrow support members 12 and 14 when the arrow is being initially placed in the archery arrow support assembly 10. An arrow to be shot from archery bow 11 would be placed on arrow support members 12 and 14 with the arrowhead pointing in the direction of arrow 42 in FIG. 1.

Figure 3:
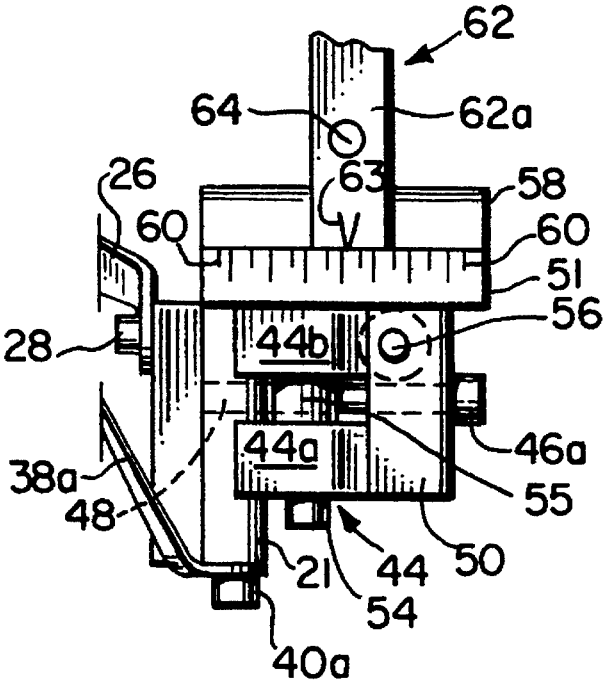
FIG. 3 is a fragmentary, top view, taken along lines 3—3 of FIG. 2.

Pivot frame 21 is forced against the pivot frame holder assembly generally indicated by the numeral 44 by screw 46 and keeper 50. Screw 46 is received in threads 48 formed in pivot frame 21 as shown in FIG. 3. Screw 46 extends through pivot frame holder assembly 44 and keeper 50, and screw cap or head 46*a* of screw forces keeper 50 into contact with pivot frame holder 44 when screw 46 is tightened.

Pivot frame holder assembly 44 includes two curved plates 44*a* and 44*b* through which extend screws 52 and 54. Pivot frame holder assembly 44 is rigidly connected to connecting plate 51 by screws 52 and 54. Spacers 53 and 55 separate curved plates 44*a* and 44*b* and screws 52 and 54 extend therethrough. Curved plate 44*a* preferably has a plurality of indicia 45 thereon.

Keeper 50 is generally "U"-shaped in cross-section and preferably has a threaded shaft 56 rotatably connected thereto as can be seen in detail in FIG. 2. Threaded shaft 56 has a cap or head 56*a* at one end and threads 56*b*. Curved plate 44*b* has a plurality of grooves or threads 44*c* therein for receipt of threads 56*b* of threaded shaft 56. Keeper 50 preferably has a "V"-shaped indicia 50*a* thereon for alignment with the indicia 45 on curved plate 44*a*. If desired, threaded shaft 56 could be omitted.

Connecting plate 51 is generally rectangular in shape and has pivot frame holder assembly 44 connected to the front face 51*a*. On the rear face 51*b* of pivot frame holder assembly 44 is "V"-shaped slide 58. On the top edge of connecting plate 51 are a plurality of parallel indicia 60.

Connecting plate holder assembly is generally indicated by the numeral 62 and includes two parallel rigid bars 62*a* and 62*b*. Preferably, bars 62*a* and 62*b* are generally rectangular in shape. Bars 62*a* and 62*b* are connected by screw 64 and screw 65. Bars 62*a* and 62*b* are separated by "V"-shaped slide 58 and spacer 70. Bars 62*a* and 62*b* have slots 72 and 74 which receive "V"-shaped slide 58. Bar 62*a* has a "V"-shaped indicia 63 thereon for alignment with the indicia 60 on connecting plate 51. If desired, although not preferred, connecting plate holder assembly 62 could be rigidly connected to connecting plate 51 and not be adjustable relative to connecting plate 51.

Flat plate 76 has bolt 78 extending therethrough to fasten connecting plate holder assembly 62 to bow 11 as shown in FIGS. 4 and 5. Bolt 78 has large head 78*a* thereon.

The adjustable archery arrow support assembly 10 enables the archer to fine tune his bow 11 to compensate for the archer's individual arrow-releasing characteristics and the individual characteristics of bow 11. Pivot frame 21 can be selectively rotated as desired relative to bow 11 by loosening screw 46 and rotating threaded shaft 56 clockwise or counter-clockwise keeper 50 and pivot frame 21 in either direction indicated by the arrows 50*b* and 21*a*. If threaded shaft 56 were omitted, pivot frame 21 can be rotated relative to bow 11 by loosening screw 46 and rotating threaded keeper 50 and pivot frame 21 clockwise or counter-clockwise in either direction indicated by the arrows 50*b* and 21*a*. The rotation of pivot frame 21 enables the direction of the net force exerted upon the arrow by arrow support members 12 and 14 to be adjusted to maximize the accuracy of the flight of an arrow shot from bow 11. Precise adjustments may be made by noting and changing the alignment of "V"-shaped indicia 50*a* relative to indicia 45.

If connecting plate holder assembly 62 is not rigidly connected to connecting plate 51 and is adjustable relative to connecting plate 51, to adjust the distance of pivot frame from bow 11, screws 64 and 65 may be loosened and connecting plate 51 moved relative to plate holder assembly 62 to align "V"-shaped indicia 63 to a desired position relative to indicia 60.

The devices of the prior art provide for vertical and horizontal adjustment. The present invention provides a third adjustment for three dimensional tuning adjustments to achieve all possible angles of response to the bending of an arrow being shot from a bow. The result is a system that easily achieves accuracy not possible without adjustment in the third dimension.

Although the preferred embodiments of the invention have been described in detail above, it should be understood that the invention is in no sense limited thereby, and its scope is to be determined by that of the following claims:

What is claimed is:

1. In an arrow support assembly for counteracting the forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly including, in combination, (a) pivot frame means for connecting to said handle section of said archery bow, (b) yoke means pivotally connected to said pivot frame means, all of said yoke means pivoting in response to the forces imposed on an arrow being shot from a bow, said yoke means having connected thereto, and extending in the direction of intended arrow flight, at least two, spaced apart, elongated, substantially non-resilient means for engaging and supporting an arrow along a substantial length of an arrow, and (c) resilient means for biasing in unison said yoke means and said means for supporting an arrow toward a predetermined neutral position as an arrow is being shot from an archery bow to counteract the vertical and horizontal forces imposed on said arrow as said arrow is being shot from said archery bow, the improvement comprising adjustment means connected to said pivot frame means for enabling said pivot frame means to be selectively rotated relative to said archery bow, said adjustment means comprising pivot frame holder means rigidly connected to said archery bow for holding said pivot frame means, and keeper means for connecting and selectively rotating said pivot frame means relative to said pivot frame holder means, said adjustment means being connected to said keeper means by fastener means.

2. The arrow support assembly of claim 1 wherein said fastener means is a screw.

3. The arrow support assembly of claim 1 wherein said keeper means has threaded shaft means for engaging said pivot frame holder means and rotating said keeper means and said pivot frame means relative to said pivot frame holder means.

4. The arrow support assembly of claim 3 where said pivot frame holder means is connected to said archery bow means by adjustable connection means for enabling the distance between said pivot frame holder means and said archery bow to be selectively changed.

5. The arrow support assembly of claim 4 wherein said adjustable connection means includes plate means rigidly connecting to said pivot frame holder means.

6. The arrow support assembly of claim 5 wherein said plate means is slidably connected to plate holder means for connecting said plate means to said bow means.

7. In an arrow support assembly for counteracting the forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly including, in combination, (a) pivot frame means for connecting to said handle section of said archery bow, (b) yoke means pivotally connected to said pivot frame means, all of said yoke means pivoting in response to the forces imposed on an arrow being shot from a bow, said yoke means having connected thereto, and extending in the direction of intended arrow flight, at least two, spaced apart, elongated, substantially non-resilient means for engaging and supporting an arrow along a substantial length of an arrow, and (c) resilient means for biasing in unison said yoke means and said means for supporting an arrow toward a predetermined neutral position as an arrow is being shot from an archery bow to counteract the vertical and horizontal forces imposed on said arrow as said arrow is being shot from said archery bow, the improvement comprising adjustment means connected to said pivot frame means for enabling said pivot frame means to be selectively rotated relative to said archery bow, said adjustment means comprising pivot frame holder means rigidly connected to said archery bow for holding said pivot frame means, and keeper means for connecting and selectively rotating said pivot frame means relative to said pivot frame holder means, said pivot frame holder means being connected to said archery bow means by adjustable connection means for enabling the distance between said pivot frame holder means and said archery bow to be selectively changed, said adjustable connection means including plate means for rigidly connecting to said pivot frame holder means.

8. The support assembly of claim 7 wherein said plate means is slidably connected to plate holder means for connecting said plate means to said bow means.

9. In an arrow support assembly for counteracting the forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly including, in combination, (a) pivot frame means for connecting to said handle section of said archery bow, (b) yoke means pivotally connected to said pivot frame means, all of said yoke means pivoting in response to the forces imposed on an arrow being shot from a bow, said yoke means having connected thereto, and extending in the direction of intended arrow flight, at least two, spaced apart, elongated, substantially non-resilient means for engaging and supporting an arrow along a substantial length of an arrow, said yoke means being pivotally connected to said pivot frame means by pivot pin means for permitting said yoke means to pivot within said pivot frame means, said pivot pin means being positioned so that an arrow being shot from an archery bow will cause said means for supporting an arrow to move downwardly and horizontally when the longitudinal axis of an archery bow is positioned vertical, and (c) resilient means for biasing in unison said yoke means and said means for supporting an arrow toward a predetermined neutral position as an arrow is being shot from an archery bow to counteract the vertical and horizontal forces imposed on said arrow as said arrow is being shot from said archery bow, the improvement comprising adjustment means connected to said pivot frame means for enabling said pivot frame means to be selectively rotated relative to said archery bow, said adjustment means comprising pivot frame holder means rigidly connected to said archery bow for holding said pivot frame means, and keeper means for connecting and selectively rotating said pivot frame means relative to said pivot frame holder means, said keeper means having threaded shaft means for engaging said pivot frame holder means and rotating said keeper means and said pivot frame means relative to said pivot frame holder means, said pivot frame holder means being connected to said archery bow means by adjustable connection means for enabling the distance between said pivot frame holder means and said archery bow to be selectively changed, said adjustable connection means including plate means for rigidly connecting to said pivot frame holder means.

10. The support assembly of claim 9 wherein said plate means is slidably connected to plate holder means for connecting said plate means to said bow means.

11. In an arrow support assembly for counteracting the forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly including, in combination, (a) pivot frame means for connecting to said handle section of said archery bow, (b) yoke means pivotally connected to said pivot frame means, all of said yoke means pivoting in response to the forces imposed on an arrow being shot from a bow, said yoke means having connected thereto, and extending in the direction of intended arrow flight, at least two, spaced apart, elongated, substantially non-resilient means for engaging and supporting an arrow along a substantial length of an arrow, said yoke means being pivotally connected to said pivot frame means by pivot pin means for permitting said yoke means to pivot within said pivot frame means, said pivot pin means being positioned so that an arrow being shot from an archery bow will cause said means for supporting an arrow to move downwardly and horizontally when the longitudinal axis of an archery bow is positioned vertical, and (c) resilient means for biasing in unison said yoke means and said means for supporting an arrow toward a predetermined neutral position as an arrow is being shot from an archery bow to counteract the vertical and horizontal forces imposed on said arrow as said arrow is being shot from said archery bow, the improvement comprising adjustment means connected to said pivot frame means for enabling said pivot frame means to be selectively rotated relative to said archery bow, said pivot frame holder means being connected to said archery bow means by adjustable connection means for enabling the distance between said pivot frame holder means and said archery bow to be selectively changed, said adjustable connection means including plate means for rigidly connecting to said pivot frame holder means.

12. The arrow support assembly of claim 11 wherein said plate means is slidably connected to plate holder means for connecting said plate means to said bow means.

13. In an arrow support assembly for counteracting the forces imposed on an arrow being shot from an archery bow, said assembly being adapted for mounting on the handle section of an archery bow having a longitudinal axis extending perpendicularly to the horizontal plane containing the longitudinal axis of intended arrow flight and having a cut-out sight window through which arrows are to be shot, said assembly including, in combination, (a) pivot frame means for connecting to said handle section of said archery bow, (b) yoke means pivotally connected to said pivot frame means, all of said yoke means pivoting in response to the forces imposed on an arrow being shot from a bow, said yoke means having connected thereto, and extending in the direction of intended arrow flight, at least two, spaced apart, elongated, substantially non-resilient means for engaging and supporting an arrow along a substantial length of an arrow, and (c) resilient means for biasing in unison said yoke means and said means for supporting an arrow toward a predetermined neutral position as an arrow is being shot from an archery bow to counteract the vertical and horizontal forces imposed on said arrow as said arrow is being shot from said archery bow, the improvement comprising adjustment means connected to said pivot frame means for enabling said pivot frame means to be selectively rotated relative to said archery bow in a plane perpendicular to said longitudinal axis of intended arrow flight.

14. The arrow support assembly of claim 13 wherein said adjustment means comprises pivot frame holder means rigidly connected to said archery bow for holding said pivot frame means, and keeper means for connecting and selectively rotating said pivot frame means relative to said pivot frame holder means.

15. The arrow support assembly of claim 14 wherein said adjustment means is connected to said keeper means by fastener means.

16. The arrow support assembly of claim 14 where said pivot frame holder means is connected to said archery bow means by adjustable connection means for enabling the distance between said pivot frame holder means and said archery bow to be selectively changed.

17. The arrow support assembly of claim 16 wherein said adjustable connection means includes plate means for rigidly connecting to said pivot frame holder means.

18. The arrow support assembly of claim 17 wherein said plate means is slidably connected to plate holder means for connecting said plate means to said bow means.

19. The arrow support assembly of claim 14 wherein said keeper means has threaded shaft means for engaging said pivot frame holder means and rotating said keeper means and said pivot frame means relative to said pivot frame holder means.

20. The arrow support assembly of claim 19 where said pivot frame holder means is connected to said archery bow means by adjustable connection means for enabling the distance between said pivot frame holder means and said archery bow to be selectively changed.

21. The arrow support assembly of claim 20 wherein said adjustable connection means includes plate means for rigidly connecting to said pivot frame holder means.

22. The arrow support assembly of claim 21 wherein said plate means is slidably connected to plate holder means for connecting said plate means to said bow means.

23. The arrow support assembly of claim 13 wherein said adjustment means comprises pivot frame holder means rigidly connected to said archery bow for holding said pivot frame means, and keeper means for connecting and selectively rotating said pivot frame means relative to said pivot frame holder means.

* * * * *